US005445895A

United States Patent [19]

Behrens et al.

[11] Patent Number: 5,445,895

[45] Date of Patent: Aug. 29, 1995

[54] MATERIAL FOR ELECTRIC CONTACTS OF SILVER WITH CARBON

[75] Inventors: Volker Behrens, Bretten; Carl L. Meyer; Karl Saeger, both of Pforzheim; Thomas Honig, Tiefenbronn; Roland Michal, Pforzheim, all of Germany

[73] Assignee: Doduco GmbH & Co. Dr. Eugen Dürrwächter, Pforzheim, Germany

[21] Appl. No.: 129,200

[22] PCT Filed: Apr. 9, 1992

[86] PCT No.: PCT/EP92/00804

§ 371 Date: Feb. 14, 1994

§ 102(e) Date: Feb. 14, 1994

[87] PCT Pub. No.: WO92/18995

PCT Pub. Date: Oct. 29, 1992

[30] Foreign Application Priority Data

Apr. 10, 1991 [DE] Germany ..... 41 11 683.6

[51] Int. Cl.[6] ..... B22F 7/08

[52] U.S. Cl. ..... 428/567; 428/546; 428/549; 428/551; 428/552; 428/568

[58] Field of Search ..... 419/11; 428/546, 551, 428/549, 552, 567, 558, 568; 505/1; 219/119; 148/23; 200/146 R; 75/232

[56] References Cited

U.S. PATENT DOCUMENTS

| | | | |
|---|---|---|---|
| 3,254,189 | 5/1966 | Evanicsko et al. | 419/4 |
| 4,127,700 | 11/1978 | Stöckel et al. | 428/558 |
| 4,699,763 | 10/1987 | Shinharoy et al. | 419/11 |
| 4,707,576 | 11/1987 | Gessinger et al. | 200/146 R |
| 4,810,289 | 3/1989 | Hoyer et al. | 75/232 |
| 4,859,825 | 8/1989 | Polvara et al. | 219/119 |
| 4,999,336 | 3/1991 | Nadkarni et al. | 505/1 |
| 5,127,969 | 7/1992 | Sekhar | 148/23 |

FOREIGN PATENT DOCUMENTS

| | | |
|---|---|---|
| 0205897 | 12/1986 | European Pat. Off. . |
| 2247544 | 5/1975 | France . |
| 2057618 | of 0000 | Germany . |
| 1948345 | 4/1970 | Germany . |

OTHER PUBLICATIONS

De-Z. "Metall", 36/7/Jul. 1982/pp. 743-746.

Doduco publication Graphor.

A. Keil, et al., "Elektrische Kontakte und Ihre Werkstoffe", published by Springer Verlag, 1984, pp. 195, 196.

*Primary Examiner*—Donald P. Walsh

*Assistant Examiner*—John N. Greaves

*Attorney, Agent, or Firm*—Dvorak and Traub

[57] ABSTRACT

A powder-metallaurgically produced material or extruded semi-finished product for electric contacts of silver or a silver-based metal material with 0.5 to 10 wt. % carbon and 0 to 2 wt. % of an additional metal. The material contains powdered carbon in combination with carbon fibers in the mass ratio of 10:1 to 1:10, whereby the diameter of the powder particles is on average smaller than half the length of the fibers.

20 Claims, 3 Drawing Sheets

MATERIAL FOR ELECTRIC CONTACTS OF SILVER WITH CARBON

BACKGROUND OF THE INVENTION

Contact materials based on silver with carbon, particulary with graphite, are widely used as protective switches in low-voltage power technology because they afford a high safety against a welding of the contacts. In most cases the contact material contains the carbon as a powder. Because silver and carbon are not soluble one in the other in a solid or liquid state, such materials can be made only by powder metallurgy. It is known to mix silver powder and graphit powder with each other and to make components by compacting said mixture, sintering and re-compacting, or to make blocks in that the powder mixture is isostatically cold-pressed, followed by sintering and shaping by extruding so that the graphite particles are oriented in the extruding direction to form fiberlike agglomerates (see A. Keil et al., "Electrische Kontakte und ihre Werkstoffe" Springer-Verlag (1984), page 195, and the company publication entitled "Graphor Kontaktwerkstoffe aus Silber-Graphit" which has been published by the applicant with the imprint 4/90):Said agglomerates are often described in the literature simply as graphite fibers. The formation of such a fibrous structure is particularly pronounced in AgC materials which are made by a repeated extruding of sheath wires filled wtih graphite powder (see K. Aüller and D. Stöckel, German periodical "Metall" 36 (1982), Page 743).

On the other hand, whereas the silver-graphite materials have a very high resistance to welding, they have also an unsatisfactory resistance to erosion and this is a disadvantage. An increasing graphite content will increase not only the resistance to welding but also the erosion. For this reason the requirements for a high resistance to welding and for a low erosion mutually preclude each other in silver-graphite contact materials.

In the contact material the graphite powder results in a hardening which is similar to dispersion hardening so that the material has a low ductility and the subsequent shaping of the contact elements is highly expensive.

Attempts have been made to increase the resistance of contact materials to erosion by an incorporation of fibers of a high-melting material (U.S. Pat. No. 3,254,189, U.S. Pat. No. 4,699,763, Published German Application 20 57 618). Published German Application 20 57 616 discloses the use of continuous filaments of carbon or graphite or of a "wool" of carbon filaments. Said filaments are impregnated with molten silver or copper, which may contain an additive consisting of 0.5 to 4% by weight flake graphite for improving the lubricating properties of sliding contacts. Because graphite is not wetted by copper, silver and their alloys, it is necessary to add a carbide-forming agent, such as titanium. But it has been found in practice that even with the use of such a wetting agent it is extremely difficult to make corresponding materials by an impregnation of a bundle of fibers or a wool of carbon filaments. Said difficulties may be avoided by the process which is described in U.S. Pat. No. 4,699,763 and in which silver powder, graphite fibers and various additives are mixed to form a slip and in a plurality of powder-metallurgical operations are processed to make contact platelets. Such materials contain carbon in the form of true carbon fibers, as is disclosed in Published German Application 20 57 618, or of graphite fibers, as is disclosed in U.S. Pat. No. 4,699,763, and their testing under conditions of use has shown that they have a distinctly higher resistance to erosion than a composite material made with graphite powder but that the resistance to welding is drastically decreased. For this reason an appreciable use of the materials made in accordance with U.S. Pat. No. 4,699,761 has not become known.

It is an object of the invention to provide a contact material which is based on silver with carbon or graphite and is superior as regards erosion and workability to the known contact materials which are based on silver with grahpite powder but as regards resistance to welding does not have the severe disadvantages of a contact material based on silver and carbon fibers.

That object is accomplished by a material having the features resited in claim 1. Desirable further features of the invention are subject matters of the dependent claims.

The contact material in accordance with the invention distinguishes in that it contains carbon in the form of pieces of fibers in combination with a content in the form of a powder. It has surprisingly been found that in the material in accordance with the invention the values for the erosion and for the resistance to welding are much more favorable than would result from the application of the rule of mixtures to the selected ratios of carbon fibers to carbon powder. The combined use of carbon fibers and carbon powder produces a result which could not have been predicted from the known effects of the individual components.

BRIEF DESCRIPTION OF THE INVENTION

Figure 2:
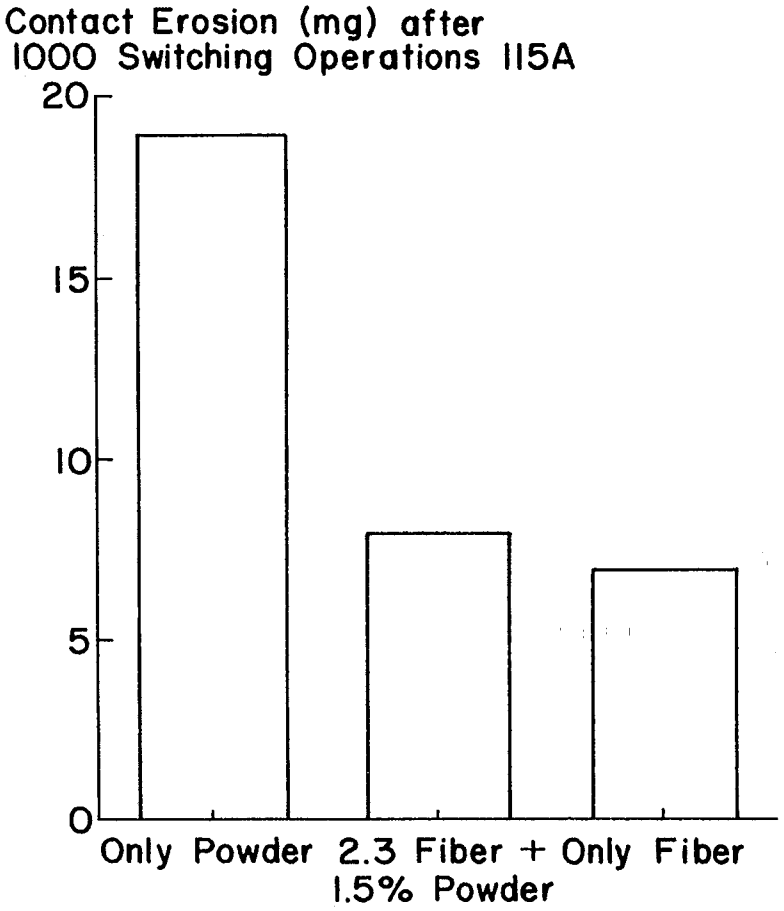
FIG. 2 is a chart illustrating a comparison of the erosion of a semi-finished product according to the present invention with a control semi-finished product which contains only carbon powder and a semi-finished product which contains only carbon fibers.

The content of carbon fibers must not be too low because otherwise their favorable influence on the decrease of erosion and the increase of the ductility would be too low. On the other hand, the content of carbon powder must not be too low because otherwise the resistance to welding would be insufficient. But the content of carbon powder must not be too high because otherwise the material could be shaped only with difficulty. In view of these aspects the total carbon content should be from 0.5 to 10% by weight and the mass ratio of the carbon powder to the carbon fibers should be restricted to values between 10:1 and 1:10, preferably to values between 1:1 and 3:1, and care should be taken to use a carbon powder which differs from the fibers or fiber fragments not only as regards particle shape but also as regards particle size because this will greatly promote the achievement of the result produced in accordance with the invention. The length of the fiber pieces in the contact material should be at least twice the diameter of the graphite powder particles. The length of the fiber pieces preferably exceeds the average diameter of the carbon powder particles by a factor of 10 to 100. The diameter of the fibers should be at least twice the average diameter of the powder particles. The fiber diameter suitably lies in the range from 1 to 50 micrometers, preferably in the range from 1 to 25 micrometers. The carbon or graphite powder may consist of a commercially available powder having an average particle diameter from 0.2 to 40 micrometers, preferably from 1 to 10 micrometers. The carbon fibers or the graphite fibers may be made by known processes. The length in which they are employed must be so short that the fibers can be uniformly mixed with the silver powder. Fibers having a length from 30 to 6000 micrometers are suitable and fibers having lenths not in excess of 500 μm are preferred. By the pressing operation, particularly the preferably succeeding extruding operation, the fibers are broken to smaller pieces so that the average length of the fibers in the final contact material is smaller than the average initial length of the fibers.

Owing to its content of coarse fibers the contact material is ductile and resists erosion. The desired resistance to welding is due to the fine carbon powder, which is present in combination with the fibers and the content of which for that purpose may be much smaller than in a material which does not contain carbon fibers but contains only carbon or graphite powder.

The metallic matrix of the material in accordance with the invention desirably consists of silver or may consist of a silver-base alloy, i.e., an alloy which consists mainly of silver and in which the other alloying element is of such a kind and present in such an amount that it does not unduly decrease the electrical conductivity. Copper and nickel are metals which are particularly suitable for being allowed with silver. Such metals may be allowed with the silver or may be combined with the silver by powder metallurgy.

The carbon content of the material should not be in excess of 10% by weight. It must be borne in mind that the carbon has a density of only about 2 g/cm$^3$, which is lower than that of silver, so that the content of carbon by volume is much higher than its content by weight. A carbon content in excess of 10% by weight will excessively embrittle the material, and a carbon content below 0.5% by weight will not sufficiently improve the resistance to welding.

To decrease the erosion, the material in accordance with the invention preferably contains one or more additional metals, namely, bismuth, calcium, lead, antimony, and/or tellurium, in an amount which is not in excess of 2% by weight. Whereas metallic additives in a silver-graphite material have already been disclosed in U.S. Pat. No. 4,699,763, the additives disclosed there consist of nickel, iron, cobalt, copper, and/or gold, which are used to facilitate the sintering of the powder particles (in that the additives act as a wetting aid) rather than to decrease the erosion. The metallic additive is preferably used in an amount of at least 0.05%. Smaller additions do not produce appreciable results. More than 2% by weight of the metallic additive should not be added because otherwise the electrical conductivity of the contact material would be excessively decreased.

The optimum carbon contact is between 2 and 7% by weight, and the optimum mass ratio of carbon fibers to carbon powder is between 1:1 and 3:1.

The carbon may be used in various modifications. For instance, the powder may consist of carbon black. The most desirable behavior will be exhibited by the material if both the carbon powder and the carbon fibers consist of graphite.

The contact material in accordance with the invention does not only have the advantage that a resistance to welding and a low erosion are combined but owing to its ductility it can be more easily processed, particularly by a subsequent shaping, so that the making of contact elements and their joining to contact carriers will be facilitated and less expensive.

Owing to the high ductility of the material in accordance with the invention the material in accordance with the invention may be used in a simple manner to make semi-finished products which inherently possess a silver backing, which is required for their brazing or welding to contact carriers. Whereas conventional silver-graphite contact materials are individually joined by pressing to a sintered silver layer or extruded contact materials are provided with a solderable rear surface in that the graphite is unilaterally burnt out (German book: "Elektrisohe Kontakte und ihre Werkstoffe", A. Keil et al., Springer-Verlag 1984, pages 195 and 196), a semi-finished product which is in accordance with the invention and has a silver backing can simply be made by co-extrusion in that a preferably cylindrical block made of the material in accordance with the invention is sheathed with silver and is then placed into an extruder for reverse extrusion by which a composite extrusion is produced, which is longitudinally slit in the die of the extruder or afterwards. Alternatively the block may be sheathed with an AgNi material. That embodiment will afford additional technological advantages if the contact platelets are applied to contact carriers by resistance welding.

EXAMPLES

EXAMPLE 1

96.2% by weight commercially available silver powder, 2.3% by weight graphitized carbon fibers 15 micrometers in diameter and 1.5% by weight graphite powder having an average particle diameter of 2 micrometers are mixed in a dry state and are subjected to isostatic cold pressing to form a billet, which is sintered under a protective gas and is then provided with e sheath of silver with 10% by weight nickel and by reverse co-extrusion is formed into strips having a thickness of 2.5 mm and a width of 20 mm. Said strips are subsequently rolled to a final thickness of 0.8 mm. Said strips may be longitudinally slit in dependence on the desired contact widths and the contact elements may be chopped off and immediately welded to contact carriers.

Figure 3:
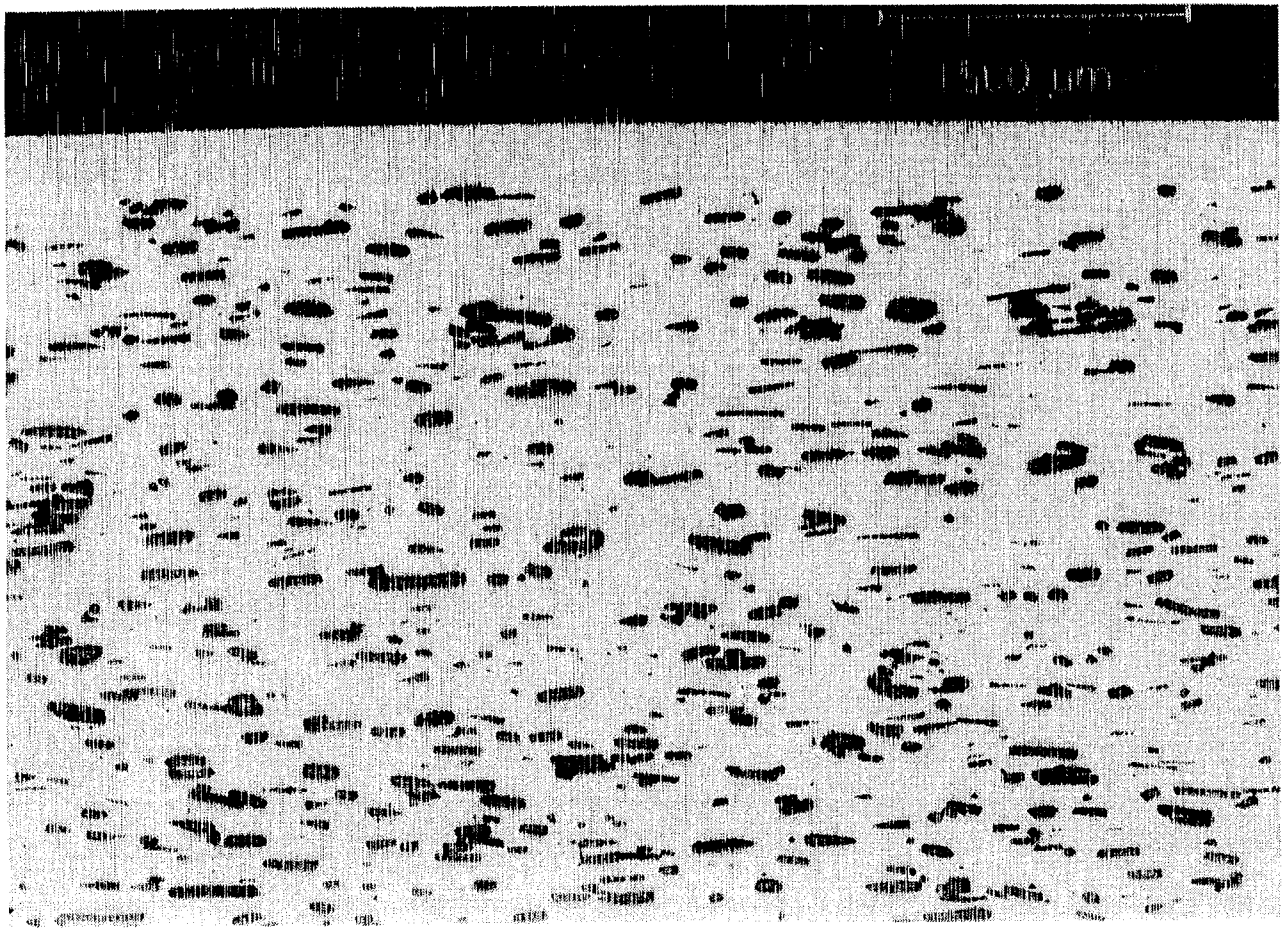
FIG. 3 is a sectional view of a metallurgical microstructure of the present invention.
Figure 4:
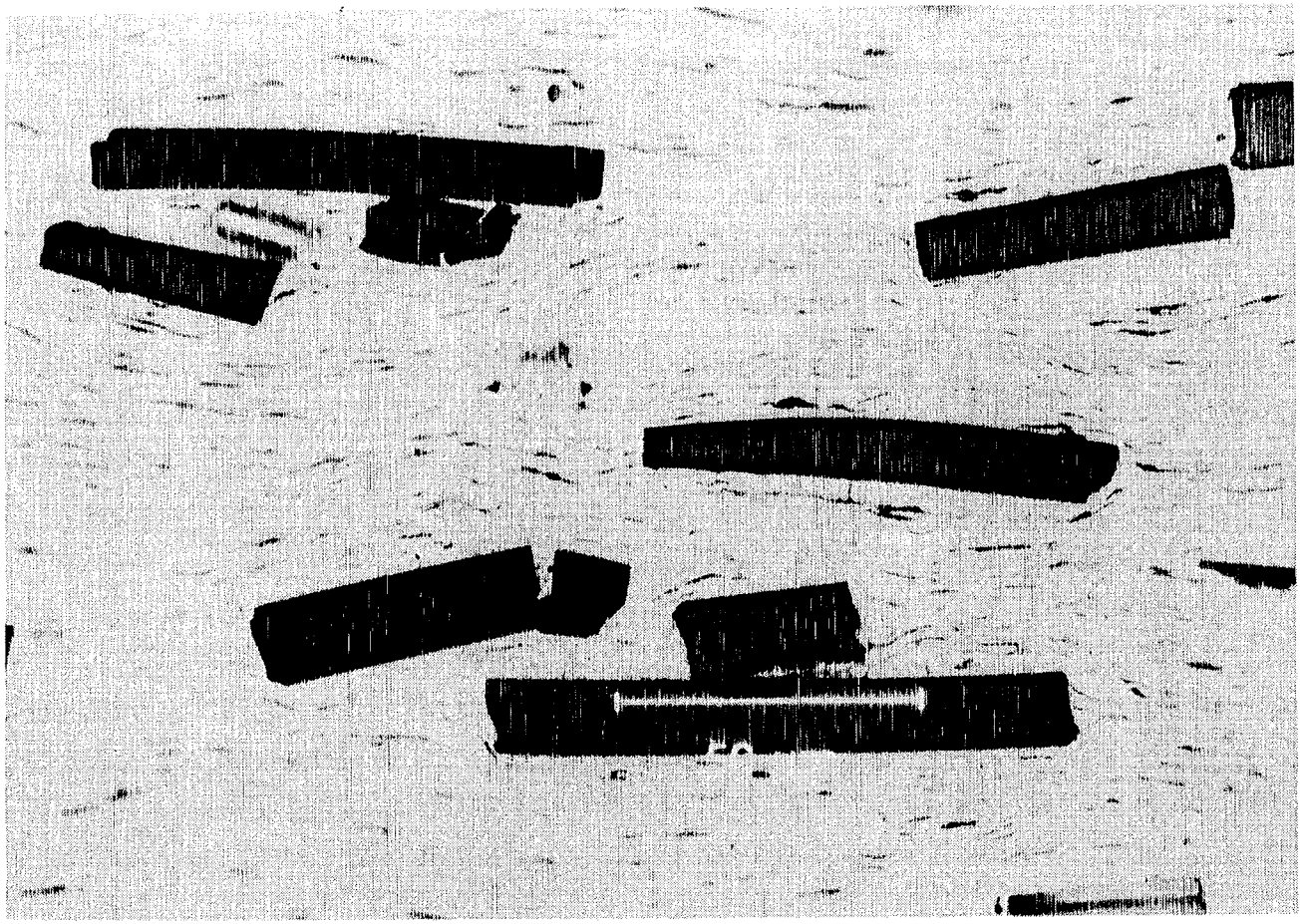
FIG. 4 is another sectional view of a metallurgical microstructure of the present invention.

A polished section of that material extending parallel to the extruding direction is shown in FIGS. 3 and 4, in FIG. 3 with a magnification of 50 diameters and in FIG. 4 in a magnification of 500 diameters. The combination of the coarse graphite fibers with the fine graphite powder in the silver matrix is distinctly apparent.

EXAMPLE 2

95% by weight commercially available silver powder, 3.5% by weight pyrolytically produced carbon fibers, 1% by weight graphite powder having an average particle size of about 1 micrometer, and 0.5% by weight bismuth powder are mixed and in the steps described in the first example are processed to form semi-finished contact strips.

CONTROL EXAMPLES

Figure 1:
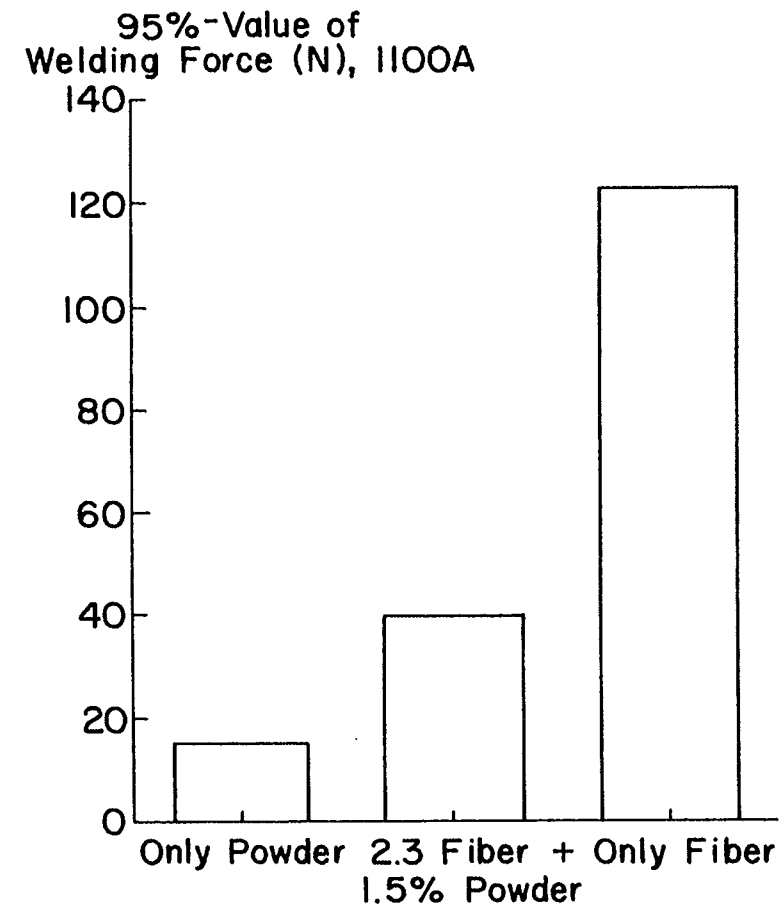
FIG. 1 is a chart illustrating a comparison of the welding forces of a semi-finished product according to the present invention with a control semi-finished product which contains only carbon powder and a semi-finished product which contains only carbon fibers.

For a comparison, two semi-finished contact strips were made, which had the same composition as in Example 1 but the carbon content of 3.8% consisted in one case only of graphite powder and in the other case only of graphitized carbon fibers. Said semi-finished products were compared to the semi-finished product made in Example 1 as regards erosion and resistance to welding. The results are shown in FIGS. 1 and 2. FIG. 1 shows that the welding forces for the semi-finished product in accordance with the invention are much closer to those of the control semi-finished product which contains only carbon powder than to those of the control semi-finisched product which contains only carbon fibers. FIG. 1 shows that as regards erosion the semi-finished product in accordance with the invention is almost exactly as good as the control semi-finished product which contained only carbon fibers.

We claim:

1. A composite material for electric contacts, consisting of silver or a silver-containing alloy or a silver-containing composite material as a metal component and of 0.5 to 10% by weight carbon, characterized in that carbon powder in combination with carbon fibers in a mass ratio from 10:1 to 1:10 are powder-metallurgically processed together with the pulverulent metal component to form a material in which the average length of the carbon fibers is more than twice the average diameter of the carbon powder particles.

2. A material according to claim 1, characterized in that the length of the fibers exceeds the average diameter of the powder particles by a factor of ten to one hundred.

3. A material according to claim 1, characterized in that the diameters of the fibers are at least twice the average diameter of the carbon powder particles.

4. A material according to claim 1, characterized in that the fiber diameter exceeds the average diameter of the powder particles by a factor from four to twenty.

5. A material according to claim 1, characterized in that the average fiber diameter is between 4 and 25 micrometers and the average powder particle diameter is between 1 and 10 micrometers.

6. A material according to claim 1, characterized in that the mass ratio of carbon fibers to carbon powder is between 1:3 and 3:1.

7. A material according to claim 1, characterized in that the total carbon content is from 2 to 7% by weight.

8. A material according to claim 1, characterized in that the silver-base material contains copper and/or nickel.

9. A material according to claim 1, characterized in that it contains 0 to 2% by weight of a metallic additive and that the metallic additive is one or more of the metals Bi, Ca, Pb, Sb, and Te.

10. A material according to claim 9, characterized in that the metallic additive is present in an amount of at least 0.05% by weight.

11. A material according to claim 3, characterized in that the fiber diameter exceeds the average diameter of the powder particles by a factor from four to twenty.

12. A material according to claim 3, characterized in that the average fiber diameter is between 4 and 25 micrometers and the average powder particle diameter is between 1 and 10 micrometers.

13. A material according to claim 4, characterized in that the average fiber diameter is between 4 and 25 micrometers and the average powder particle diameter is between 1 and 10 micrometers.

14. A material according to claim 3, characterized in that the mass ratio of carbon fibers to carbon powder is between 1:3 and 3:1.

15. A material according to claim 4, characterized in that the mass ratio of carbon fibers to carbon powder is between 1:3 and 3:1.

16. A material according to claim 5, characterized in that the mass ratio of carbon fibers to carbon powder is between 1:3 and 3:1.

17. A material according to claim 1, characterized in that the mass ratio of carbon fibers to carbon powder is between 1:1 and 3:1.

18. A material according to claim 3, characterized in that the mass ratio of carbon fibers to carbon powder is between 1:1 and 3:1.

19. A material according to claim 4, characterized in that the mass ratio of carbon fibers to carbon powder is between 1:1 and 3:1.

20. A material according to claim 5, characterized in that the mass ratio of carbon fibers to carbon powder is between 1:1 and 3:1.

* * * * *